US007874599B2

(12) United States Patent
Suzumura et al.

(10) Patent No.: US 7,874,599 B2
(45) Date of Patent: Jan. 25, 2011

(54) DOOR LOCK APPARATUS FOR VEHICLES

(75) Inventors: Makoto Suzumura, Chita (JP); Akira Muramatsu, Chiryu (JP); Yukinobu Kunimatsu, Toyoake (JP); Shigeru Tanabe, Obu (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 683 days.

(21) Appl. No.: 11/667,852

(22) PCT Filed: Nov. 16, 2005

(86) PCT No.: PCT/JP2005/021400

§ 371 (c)(1),
(2), (4) Date: May 16, 2007

(87) PCT Pub. No.: WO2006/054761

PCT Pub. Date: May 26, 2006

(65) Prior Publication Data

US 2008/0048458 A1 Feb. 28, 2008

(30) Foreign Application Priority Data

Nov. 16, 2004 (JP) ..... 2004-332062

(51) Int. Cl.
*E05C 3/06* (2006.01)

(52) U.S. Cl. ..... 292/216; 292/201; 292/DIG. 23

(58) Field of Classification Search ..... 292/216, 292/201, DIG. 23, DIG. 41, DIG. 52, DIG. 64, 292/DIG. 54

See application file for complete search history.

(56) References Cited

U.S. PATENT DOCUMENTS 6,332,634 B1 * 12/2001 Fukumoto et al. ..... 292/201
6,336,668 B1 * 1/2002 Bendel ..... 292/214

(Continued)

FOREIGN PATENT DOCUMENTS

GB 2 365 487 A 2/2002

(Continued)

*Primary Examiner*—Carlos Lugo
*Assistant Examiner*—Mark Williams
(74) *Attorney, Agent, or Firm*—Buchanan Ingersoll & Rooney PC

(57) ABSTRACT

The present invention provides a support structure for a latch actuating lever and a lock actuating lever, which realizes a small and compact door lock apparatus for vehicles. The door lock apparatus includes a latch mechanism for maintaining a vehicle door in a closed state relative to a vehicle body, a latch actuating link coupled to the latch mechanism and actuating the latch mechanism to place the vehicle door in an openable state relative to the vehicle body, a lock actuating link for connecting or disconnecting the latch actuating link to or from the latch mechanism and thus making the latch mechanism operable or inoperable when the latch actuating link is actuated, and a base unit for supporting the latch actuating link and the lock actuating link. The base unit includes an annular support and a support shaft held in the annular support. At least one latch actuating lever, constituting the latch actuating link, is rotatablely supported on either one of the annular support and the support shaft, and at least one lock actuating lever, constituting the lock actuating link, is rotatablely supported on the other one of the annular support and the support shaft.

10 Claims, 10 Drawing Sheets

U.S. PATENT DOCUMENTS 6,575,506 B2 * 6/2003 Hayakawa et al. ..... 292/216

FOREIGN PATENT DOCUMENTS

JP 2001-262905 A 9/2001
JP 2001-271540 A 10/2001
JP 2001-303823 A 10/2001
JP 2002-38799 A 2/2002
JP 2002-327576 A 11/2002
JP 2003-184390 A 7/2003

* cited by examiner

DOOR LOCK APPARATUS FOR VEHICLES

TECHNICAL FIELD

The present invention relates to a door lock apparatus for vehicles, which maintains the closed state of a vehicle door relative to a vehicle body and secures the locked state of the vehicle door.

BACKGROUND ART

One conventional door lock apparatus for vehicles is disclosed in Patent Document 1. The vehicle door lock apparatus disclosed in the Patent Document 1 comprises a latch mechanism for maintaining the closed state of a vehicle door relative to a vehicle body, a latch actuating lever coupled to the latch mechanism and actuating the latch mechanism so that the vehicle door is openable relative to the vehicle body, a lock actuating lever connecting or disconnecting the latch actuating lever to or from the latch mechanism and thus putting the vehicle door in an unlocked state, in which the latch mechanism can be operated in response to manipulation of the latch actuating lever, or putting the vehicle door in a locked state, in which the latch mechanism cannot be operated even if the latch actuating lever is manipulated, and a base unit that rotatablely supports the latch actuating lever and the lock actuating lever therein.

The base unit comprises a casing and a cover, which house the latch actuating lever and the lock actuating lever. The latch actuating lever is rotatablely supported in the base unit by a support pin of the cover. The lock actuating lever is rotatablely supported in the base unit by fitting a shaft, integrated with the lock actuating lever into both the casing and the cover.

(Patent Document 1: Japanese Patent Laid-open Publication No. 2002-327576)

DISCLOSURE OF THE INVENTION

Problems to be Solved by the Invention

As described above, in the conventional vehicle door lock apparatus, the latch actuating lever is supported in the base unit using the support pin, while the lock actuating lever is supported in the base unit using the shaft, which is integrated with the lock actuating lever. In other words, the latch actuating lever and the lock actuating lever are supported in the base unit at different locations using the support pin and the shaft, respectively, which are separate members. Thus, the size of the base unit may be increased, resulting in an increase in the size of the vehicle door lock apparatus and often making it difficult to install the vehicle door lock apparatus in the vehicle door.

Therefore, the present invention has been made in view of the above limitations, and the present invention provides a support structure for a latch actuating lever and a lock actuating lever, which realizes a small and compact door lock apparatus for vehicles.

Means for Solving the Problems

The present invention provides a compact vehicle door lock apparatus by coaxially arranging at least one latch actuating lever and at least one lock actuating lever. Described in detail, the vehicle door lock apparatus according to the present invention comprises a latch mechanism for maintaining a vehicle door in a closed state relative to a vehicle body, a latch actuating link coupled to the latch mechanism and actuating the latch mechanism to place the vehicle door in an openable state relative to the vehicle body, a lock actuating link for connecting or disconnecting the latch actuating link to or from the latch mechanism and thus making the latch mechanism operable or inoperable when the latch actuating link is actuated, and a base unit for supporting the latch actuating link and the lock actuating link, wherein the base unit provides an arcuate annular support comprising an inner surface and an outer surface and a support shaft held in the annular support, the support shaft comprises a flange part which has a diameter greater than the outer surface of the annular support and is combined with one end of the annular support, the support shaft comprises a fixing part which is press fitted into the annular support such that the fixing part contacts with the inner surface of the annular support, and which extends from a first side of the flange part; a first support part that extends from a second side of the flange part; a second support part that extends from the first support part and has a diameter smaller than the first support part; and an insert part that extends from the second support part and has a diameter smaller than the second support part, at least one latch actuating lever constituting the latch actuating link is rotatablely supported on either one of the annular support and the support shaft, and at least one lock actuating lever constituting the lock actuating link is rotatablely supported on the other one of the annular support and the support shaft.

In the vehicle door lock apparatus according to the present invention, at least one latch actuating lever composing the latch actuating link and at least one lock actuating lever composing the lock actuating link are coaxially supported on both the annular support of the base unit and on the support shaft secured to the annular support, thus realizing a small base unit and providing a compact door lock apparatus for vehicles.

The base unit of the vehicle door lock apparatus may comprise a casing having the annular support, and a cover which is secured to the casing, supports one end of the support shaft, and houses both the latch actuating lever and the lock actuating lever therein in cooperation with the casing. The support shaft is secured at a first end thereof to the annular support of the casing and is supported at a second end thereof by the cover, so that opposite ends of the support shaft can be supported by the casing and the cover. Thus, the support shaft can be prevented from deformation even if a heavy load is placed on the support shaft.

The annular support of the base unit may be shaped as an annular body having an inner surface and an outer surface. The support shaft may comprise a fixing part which is press fitted into the annular support such that the fixing part contacts with the inner surface of the annular support. Thus, the support shaft can be easily and reliably secured to the annular support.

The support shaft may comprise a flange part, which has a diameter greater than the outer surface of the annular support and is engaged with one end of the annular support. Further, the support shaft may comprise a flange part, a fixing part that extends from a first side of the flange part, a first support part that extends from a second side of the flange part, a second support part that extends from the first support part and has a diameter smaller than the first support part, and an insert part that extends from the second support part and has a diameter smaller than the second support part. Further, the latch actuating lever can be prevented from contacting with the lock actuating lever by arranging the latch actuating lever and the lock actuating lever on the first and second ends of the flange part, respectively. Thus, a malfunction of the vehicle door lock apparatus, in which the latch actuating lever and the lock actuating lever are rotated in conjunction with each other, can be prevented.

The latch actuating link may comprise a first lever rotated by a door handle, an opening lever rotated through a slide bush in response to the rotation of the first lever, and a lift lever, which is rotated through an open link in response to the rotation of the opening lever, thus opening or closing the latch mechanism. The first lever, which is rotated by the door handle; may be rotated by an outside door handle, manipulated from outside of the door, or may be rotated by an inside door handle, manipulated from inside of the door. Further, the latch actuating link may comprise a small number of latch actuating levers or a large number of latch actuating levers.

The lock actuating link may comprise a locking lever which may be rotated by a motor or a lock knob, and an open link, which is rotated between a locked state and an unlocked state through a bush in response to the rotation of the locking lever. The lock actuating link may comprise a small number of lock actuating levers or a large number of lock actuating levers.

As will be described for an embodiment later herein, the latch actuating lever, which is rotatablely supported on the annular support or the support shaft, may be used as the opening lever, while the lock actuating lever, which is rotatablely supported on the annular support or the support shaft, may be used as the locking lever. Further, the first lever may be used as an inside lever, and may be rotatablely supported on the support shaft. In the above state, a slide bush may be slidably supported on the opening lever and may be connected to or disconnected from the inside lever. The opening lever may have a flange wall on a periphery thereof such that a front end surface of the flange wall comes into contact with the inside lever in an axial direction and an inner surface of the flange wall contacts with an outer surface of the support shaft, and a bore formed to receive the support shaft.

Further, the locking lever may comprise an active lever, which is rotatablely supported around the annular support, and a sub-lever, which is supported on the active lever to be rotated relative to the active lever at a location around the support shaft.

ADVANTAGES OF THE INVENTION

In the vehicle door lock apparatus according to the present invention, at least one latch actuating lever and at least one lock actuating lever are coaxially and rotatablely supported on both the annular support of the base unit and the support shaft secured to the annular support, thus realizing a small base unit and a compact vehicle door lock apparatus.

Further, the lock actuating lever of the vehicle door lock apparatus according to the present invention is supported on the annular support of the base unit, thus increasing the support strength in comparison with the conventional vehicle door lock apparatus.

Further, opposite ends of the support shaft are supported by the casing and the cover of the base unit, respectively, so that the support shaft realizes a two-sided support structure relative to the base unit, thus increasing the support strength of the actuating lever in comparison with the related art. Further, the annular support, which supports the lock actuating lever and is combined with the support shaft for supporting the opening lever, is provided in the casing, thus supporting both the latch actuating lever and the lock actuating lever in the casing and increasing the ease of assembly of the vehicle door lock apparatus.

BEST MODE FOR CARRYING OUT THE INVENTION

Figure 1:
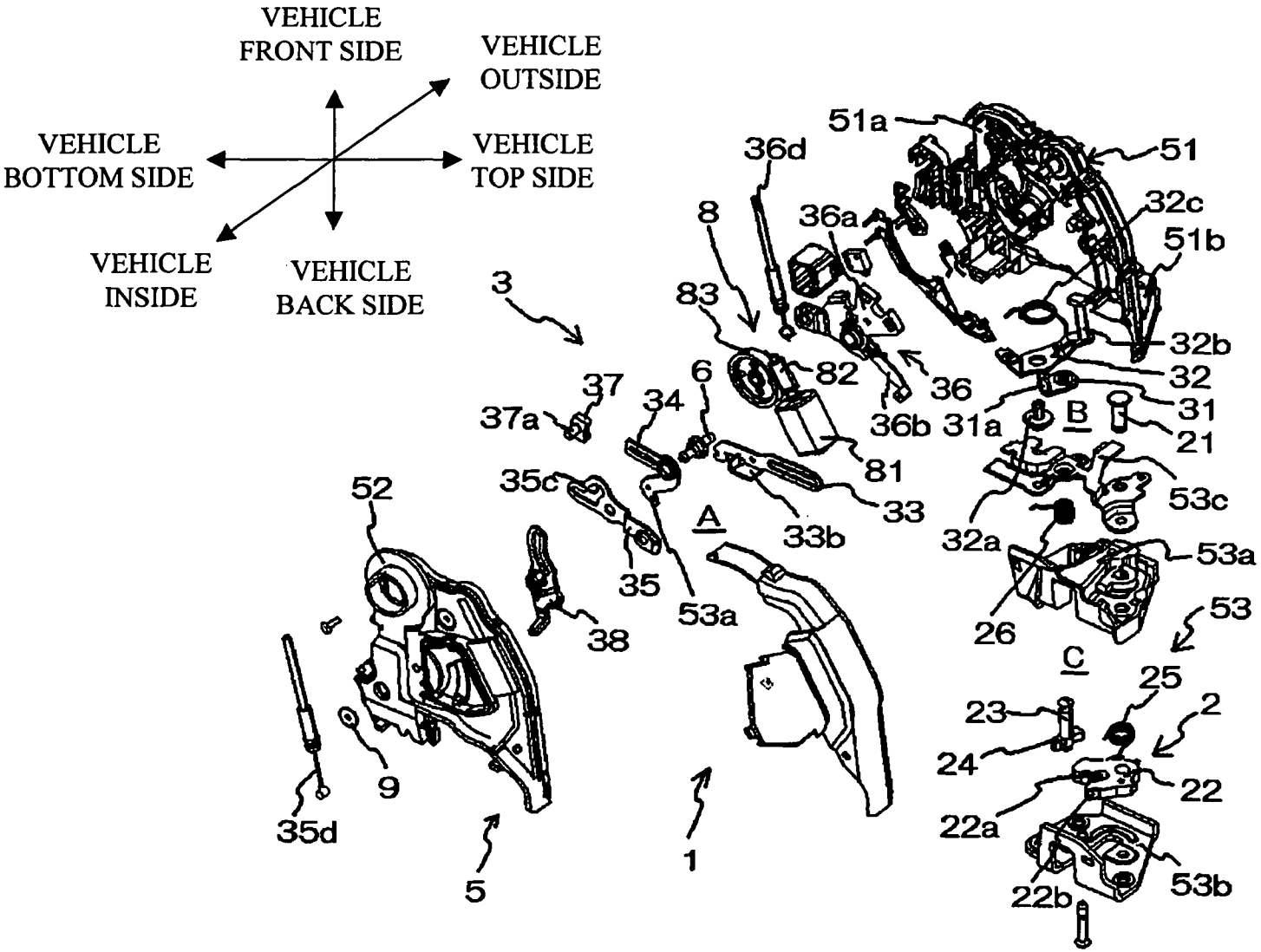
FIG. 1 is a perspective exploded view illustrating the components of a vehicle door lock apparatus according to the present invention.
Figure 2:
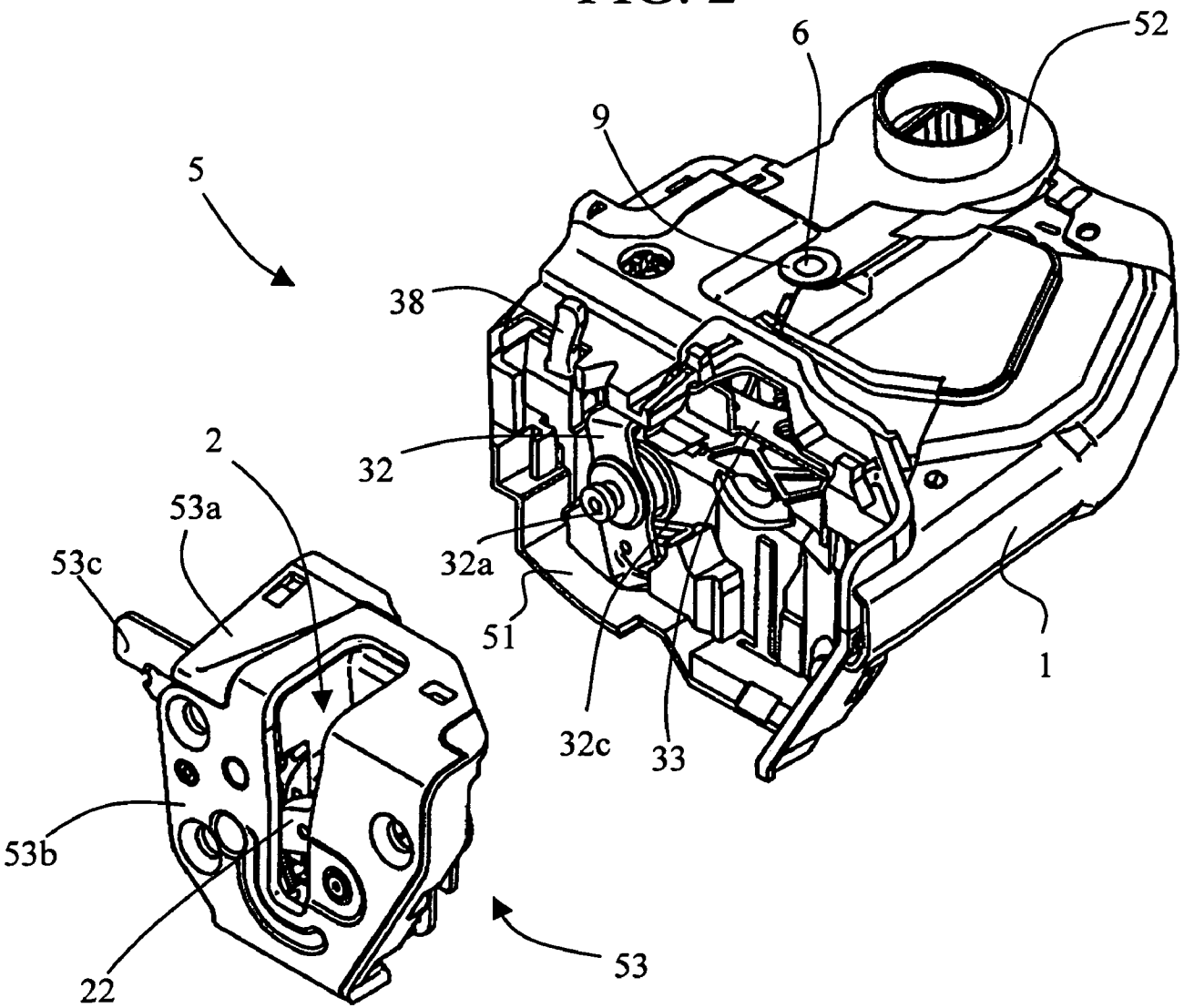
FIG. 2 is a perspective view illustrating the construction of the vehicle door lock apparatus according to the present invention.

Hereinafter, a vehicle door lock apparatus according to an embodiment of the present invention will be described. The vehicle door lock apparatus according to the present invention (hereinbelow, referred to simply as "door lock apparatus") is securely mounted in a vehicle rear door (not shown) and is locked to or unlocked from a striker (not shown), which is securely mounted in a vehicle body (not shown). As shown in FIG. 1, which is a developed perspective view illustrating the components of the door lock apparatus according to the present invention, the door lock apparatus comprises a latch mechanism 2 for maintaining the rear door in a closed state, a link mechanism 3 for actuating the latch mechanism 2 so that the rear door is openable, and a housing 5 receiving both the latch mechanism 2 and the link mechanism 3 therein. FIG. 2 is a perspective view illustrating the latch mechanism 2, which is separated from the door lock apparatus.

The door lock apparatus according to the embodiment of the present invention has a complex construction, and thus the housing 5 (see FIG. 7), constituting a base unit, which is the important part of the present invention, and part of a latch actuating lever and a lock actuating lever of the link mechanism 3 will be first described.

The housing 5 configured in the base unit of the present invention comprises a boss part 7 constituting the annular support of the present invention, and a support shaft 6 constituting the support shaft of the present invention. The housing 5 includes a main casing 51 (constituting the casing of the present invention), which is produced through synthetic resin injection molding, and a first cover 52 (constituting the cover of the present invention), which is produced through synthetic resin injection molding. The main casing 51 and the first cover 52 are securely assembled with each other into a single body, and define a hermetic first cavity A therein.

The boss part 7, which constitutes the annular support of the present invention, is shaped as an annular part which protrudes from the inner surface of the main casing 51, with an inner surface 72 and an outer surface 71 formed in the boss part 7 to realize an one end-opened shaft opening.

The support shaft 6 of the present invention is shaped as a cylindrical body, with a flange part 61 formed around the middle portion of the cylindrical support shaft 6. The support shaft 6 comprises a fixing part 62, which is inserted into the shaft hole of the boss part 7 and contacts with the inner surface 72 of the boss part 7. Described in detail, the first end (end on the right-hand side of FIG. 7) of the support shaft 6, based on the flange part 61, forms the fixing part 62, which has a diameter almost equal to or slightly greater than the inner surface 72 of the boss part 7. Further, the flange part 61 has a diameter greater than the outer surface 71 of the boss part 7, and is engaged with the end of the boss part 7. Further, the support shaft 6 comprises the flange part 61, the fixing part 62 extending from the flange part 61 in one direction, a first support part 63 extending from the flange part 61 in the other direction, a second support part 64 extending from the first support part 63 and having a diameter smaller than the first support part 63, and an insert part 65 extending from the second support part 64 and having a diameter smaller than the second support part 64. Described in detail, the second end (the end on the left-hand side of FIG. 7) of the support shaft 6, based on the flange part 61, forms the first support part 63 having the diameter greater than the fixing part 62, the second support part 64 having the diameter smaller than the first support part 63, and the insert part 65 having the diameter smaller than the second support part 64. The support shaft 6 is inserted into the boss part 7 such that the outer surface of the fixing part 62 contacts with the inner surface 72 of the boss part 7, thus being securely installed in the main casing 51. The insert part 65 is inserted into a through hole 52*a* of the first cover 52 and is held by a washer 9 at a desired location relative to the first cover 52. Thus, the support shaft 6 is supported at opposite ends thereof by the main casing 51 and the first cover 52, so that the support shaft 6 is stably held in the housing 5.

The inside opening lever 34, which constitutes the latch actuating lever of the link mechanism 3 of the present invention, is rotatablely supported on the support shaft 6 by fitting the first support part 63 of the support shaft 6*a* into a bore 34*c* of the inside opening lever 34 such that the inner surface of a flange wall 34*b* of the inside opening lever 34 contacts with the outer surface of the first support part 63 of the support shaft 6. Further, the inside lever 35, which constitutes another latch actuating lever of the present invention, is rotatablely supported on the support shaft 6 by fitting the second support part 64 of the support shaft 6 into a through hole 35*e* of the inside lever 35 such that the inner surface of the through hole 35*e* contacts with the outer surface of the second support part 64 of the support shaft 6. In the above state, the inside lever 35 is placed between the inside opening lever 34 and the first cover 52 such that the inside lever 35 can be in contact with the end surface of the flange wall 34*b*. The inside opening lever 34 is placed between the flange part 61 and the inside lever 35 such that the inside opening lever 34 can be in contact with the flange part 61. Thus, axial misalignment of the inside lever 35 relative to the inside opening lever 34 can be prevented. As described above, the inside opening lever 34 and the inside lever 35 are supported on the support shaft 6 that is held at opposite ends thereof in the housing 5, so that the support strength of the levers 34 and 35 can be increased.

A locking lever 36 constituting the lock actuating lever of the present invention comprises an active lever 36*a* and a sub-lever 36*b*. The active lever 36*a* is rotatablely supported around the outer surface 71 of the boss part 7, which securely receives the support shaft 6. Further, the sub-lever 36*b* is rotatablely supported around the active lever 36*a*, outside the support shaft 6. The locking lever 36 is supported around the outer surface 71 of the thick boss part 7, so that the locking lever 36 can withstand high torque.

Figure 7:
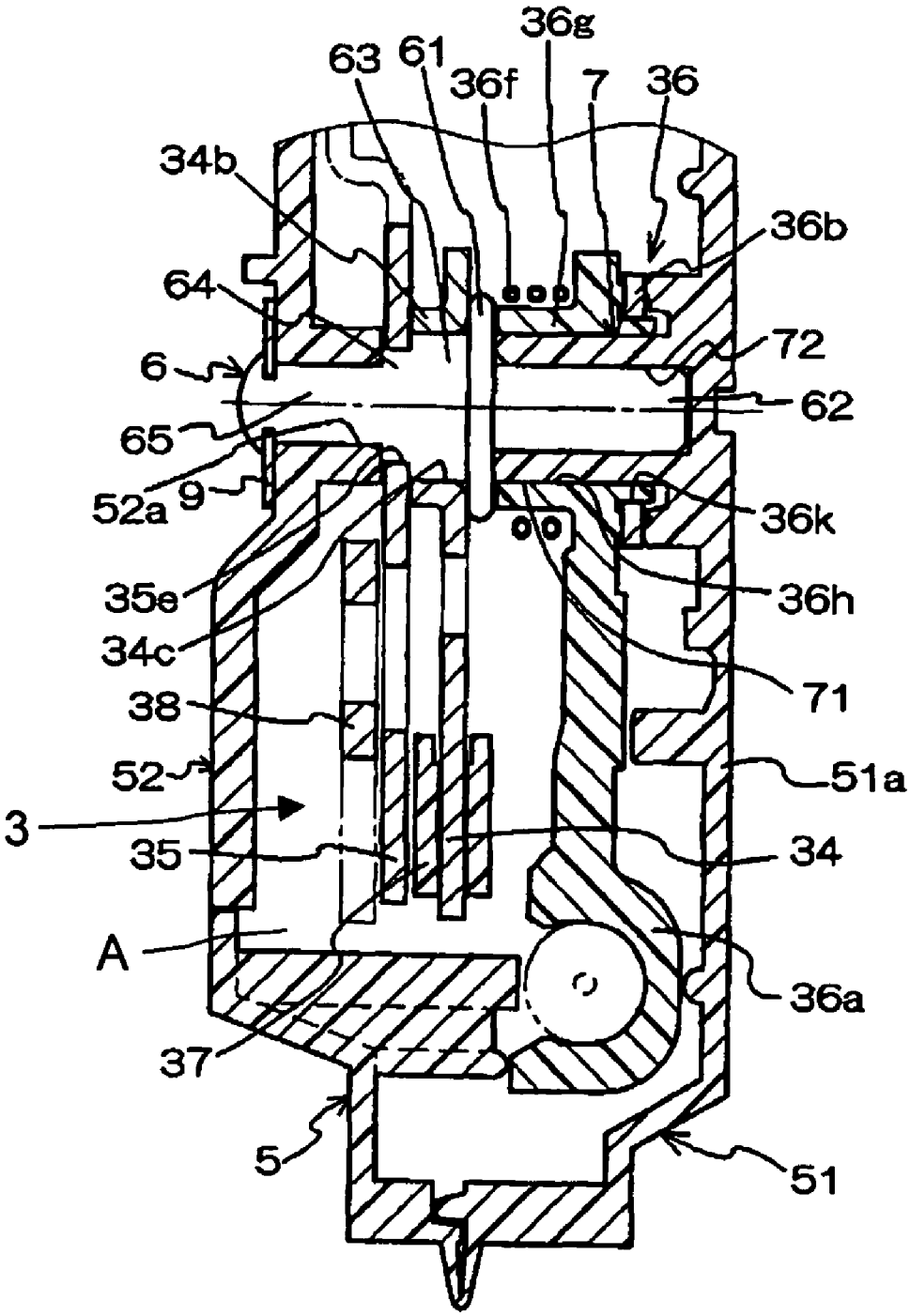
FIG. 7 is a sectional view illustrating the vehicle door lock apparatus according to the present invention.

As shown in FIG. 7, the inside opening lever 34 and the inside lever 35, which constitute the latch actuating levers of the link mechanism 3 of the present invention, and the locking lever 36, which constitutes the lock actuating lever, are coaxially arranged, thus realizing a compact structure.

The door lock apparatus according to the embodiment of the present invention will be described in detail hereinbelow.

Figure 4:
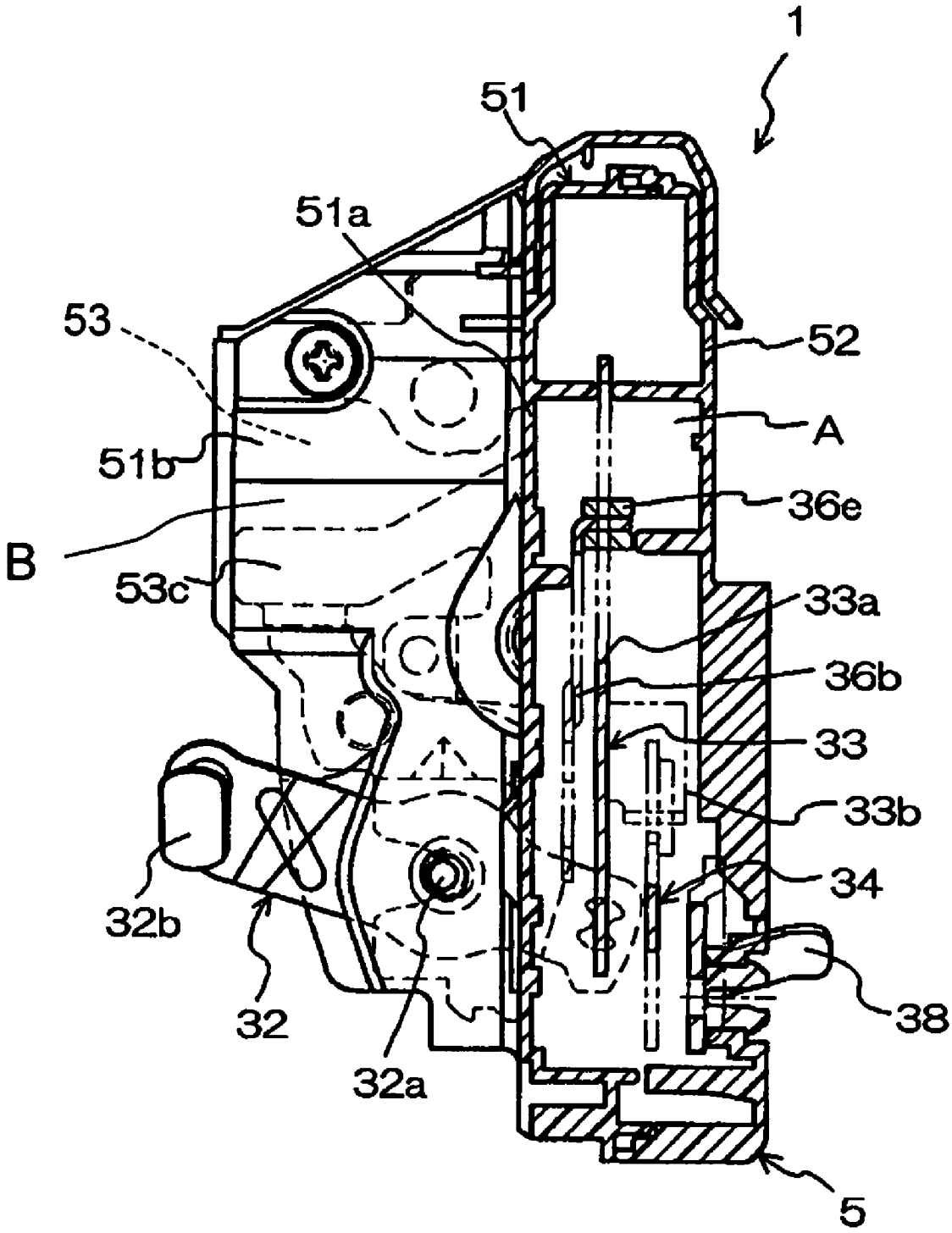
FIG. 4 is a front view illustrating the vehicle door lock apparatus according to the present invention.

As shown in FIG. 2 and FIG. 4, the housing 5 comprises the plastic main casing 51, the plastic first cover 52 and a second cover 53. The main casing 51 comprises a first casing part 51*a* and a second casing part 51*b*, which is integrated with the first casing part 51*a* and perpendicularly extends from the first casing part 51*a*. The first cover 52 is secured to the main casing 51 such that the first cover 52 overlaps the first casing part 51*a*. The first cover 52 and the first casing part 51*a* of the main casing 51 form the hermetic first cavity A in the housing 5. The housing 5 constitutes the base unit of the present invention. Further, the main casing 51 constitutes the casing of the present invention, while the first cover 52 constitutes the cover of the present invention.

Figure 5:
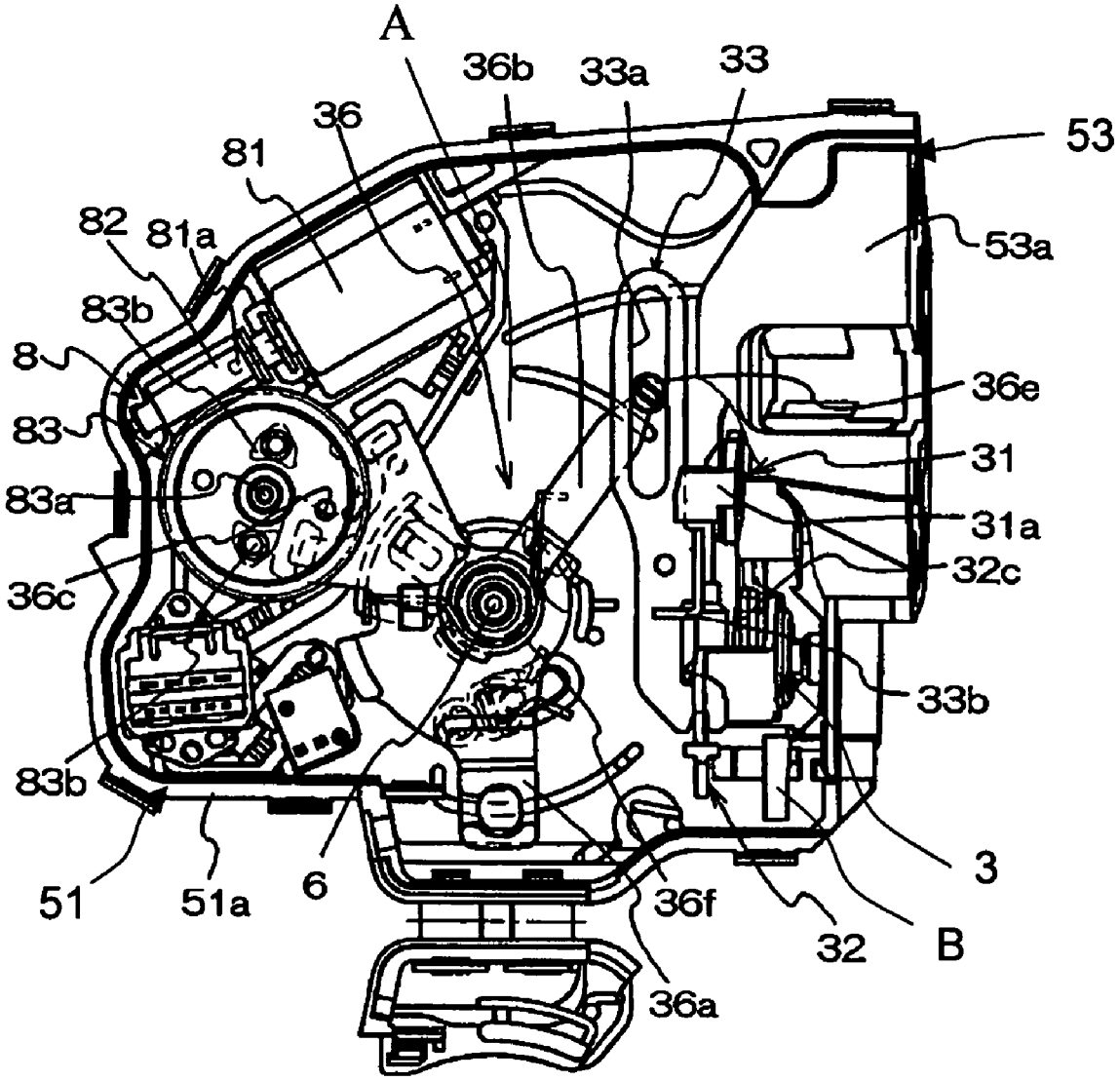
FIG. 5 is a front view illustrating a link mechanism of the vehicle door lock apparatus according to the present invention in an unlocked state.
Figure 5:
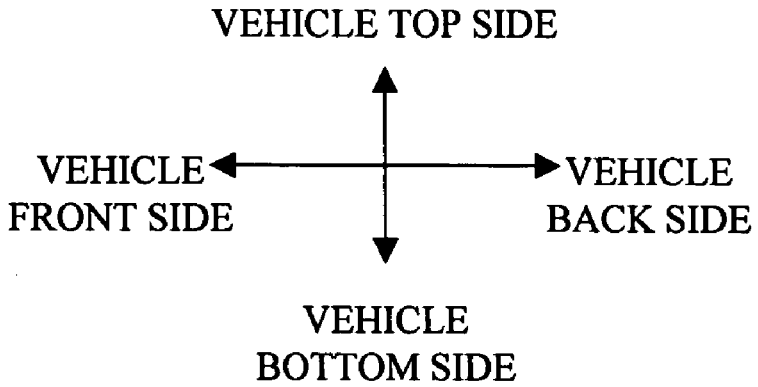

As shown in FIG. 4 and FIG. 5, the second cover 53 is mounted to the main casing 51 such that the second cover 53 overlaps the second casing part 51*b*. The second cover 53 and the second casing part 51*b* define a second cavity B in the housing 5.

The second cover 53 comprises a box-shaped plastic body 53*a*, a metal base plate 53*b* and a metal sub-base plate 53*c*. The base plate 53*b* is mounted to the plastic body 53*a* and defines a third cavity C in the housing 5 in cooperation with the plastic body 53*a*. The plastic body 53*a* is mounted to the main casing 51 by the sub-base plate 53*c*.

Figure 3:
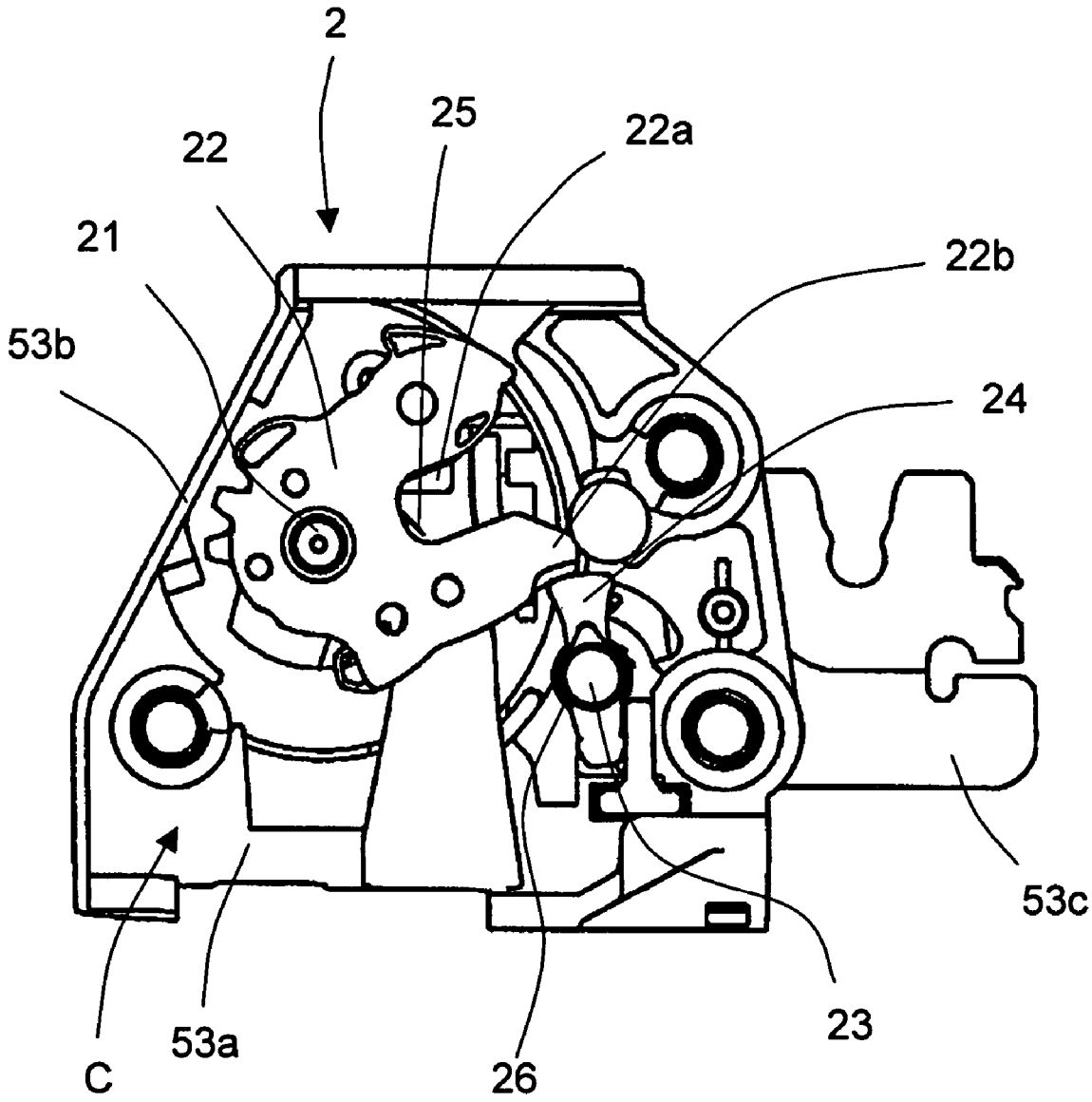
FIG. 3 is a plane view illustrating a latch mechanism of the vehicle door lock apparatus according to the present invention.

As shown in FIG. 3, the latch mechanism 2 is received in the third cavity C. A latch shaft 21 is caulked to the base plate 53*b*, while a latch 22 is rotatablely supported on the latch shaft 21. Further, the latch mechanism 2 includes a pawl 24, which is rotatablely supported on the base plate 53*b* by a pawl shaft 23, which is parallel to the latch shaft 21.

The latch 22 is provided on the outer surface thereof with a locking slot 22*a*, which receives the striker (not shown) therein, and a click 22*b*, which engages with or disengages from the pawl 24. Further, as shown in FIG. 3, the latch 22 is biased by a spring 25 to be rotated in one direction, while the pawl 24 is biased by another spring 26 to be rotated in the other direction, opposite the direction of rotation of the latch 22.

When the latch mechanism 2 is in a latched state, the striker (not shown) engages with the locking slot 22*a* of the latch 22, and the pawl 24 engages with the click 22*b* of the latch 22, so that the latch 22 can be prevented from being rotated regardless of the biasing force of the spring 25. Thus, the rear door can be maintained in a closed state relative to the vehicle body.

When the pawl 24 in the latched state of the latch mechanism 2 is rotated in one direction while overcoming the biasing force of the spring 26, the pawl 24 disengages from the click 22*b* of the latch 22, so that the latch 22 can be rotated in the direction by the biasing force of the spring 25. In other words, the latch mechanism 2 is put in an unlatched state, in which the striker can be removed from the locking slot 22*a* of the latch 22. Thus, the rear door is put in an openable state relative to the vehicle body.

Figure 6:
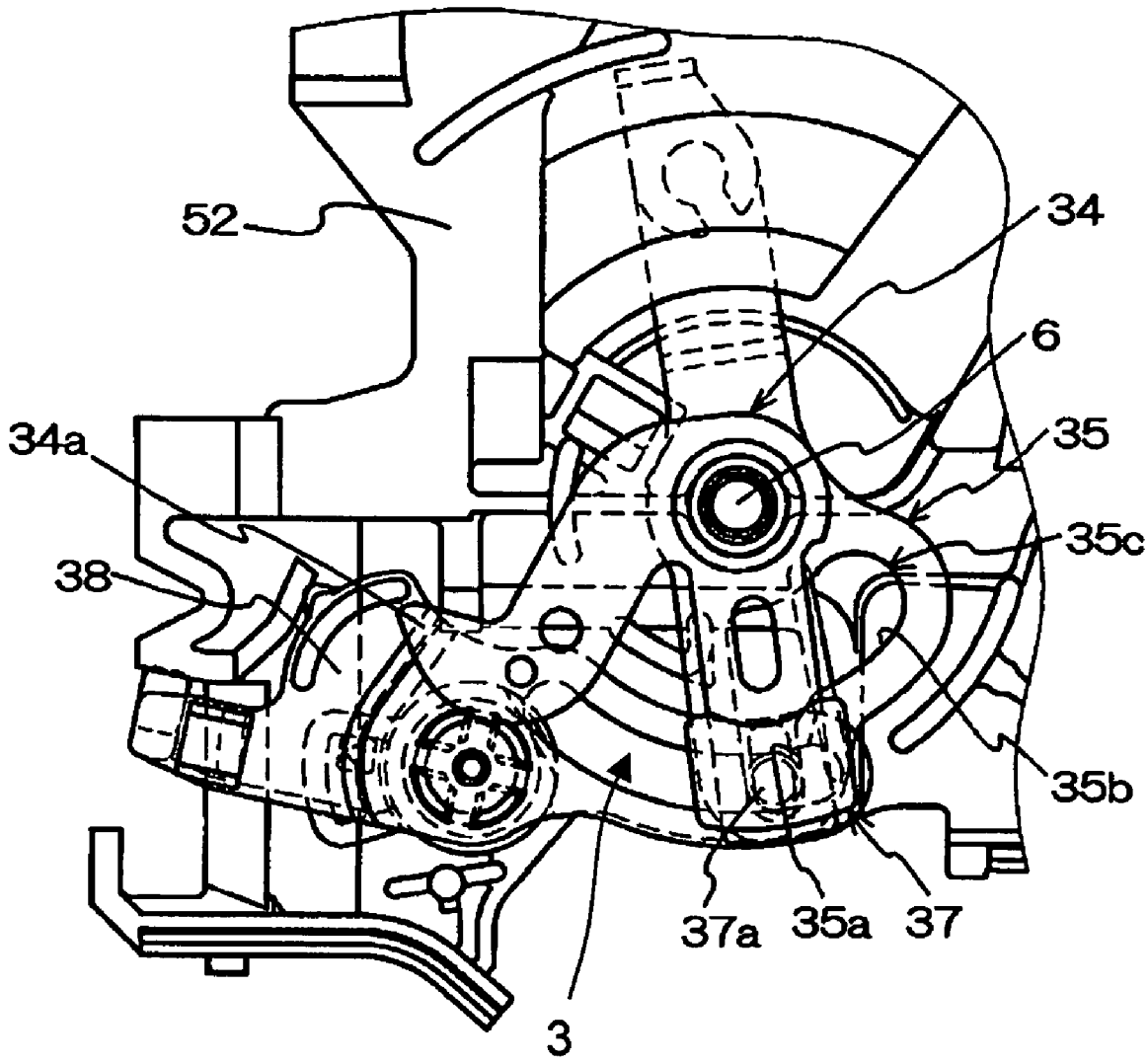
FIG. 6 is a front view illustrating an inside opening lever of the link mechanism of the vehicle door lock apparatus according to the present invention.

As shown in FIG. 5 and FIG. 6, the link mechanism 3 comprises a lift lever 31, an outside opening lever 32, an open link 33, an inside opening lever 34, an inside lever 35 and a locking lever 36. Further, the inside lever 35 constitutes a first lever of the present invention. Further, the inside opening lever 34 constitutes an opening lever of the present invention. As described above, the inside lever 35, the inside opening lever 34, and the lift lever 31 constitute the latch actuating link of the present invention.

Further, the locking lever 36 constitutes a lock actuating lever of the present invention. The locking lever 36 and the open link 33 constitute the lock actuating link of the present invention.

The lift lever 31 and the outside opening lever 32 are received in the second cavity B. The pawl shaft 23, which is rotated along with the pawl 24, extends into the second cavity B through both the plastic body 53*a* and the sub-base plate 53*c*. The lift lever 31 engages with the extension of the pawl shaft 23 and rotates along with the pawl shaft 23. Further, a flange wall 31*a* is provided on the lift lever 31.

As shown in FIG. 4, the outside opening lever 32 is rotatablely supported on the sub-base plate 53*c* by a pin 32*a* mounted to the sub-base plate 53*c*. The outside opening lever 32 is coupled to an outside door handle (not shown) of the rear door using a connection pin 32*b*, which is provided on an end of the outside opening lever 32. Further, a spring 32*c* (see FIG. 1 and FIG. 2) is engaged with the outside opening lever 32, so that the outside opening lever 32 can be maintained at an initial position, shown in FIG. 4, by the biasing force of the spring 32*c*.

Figure 9:
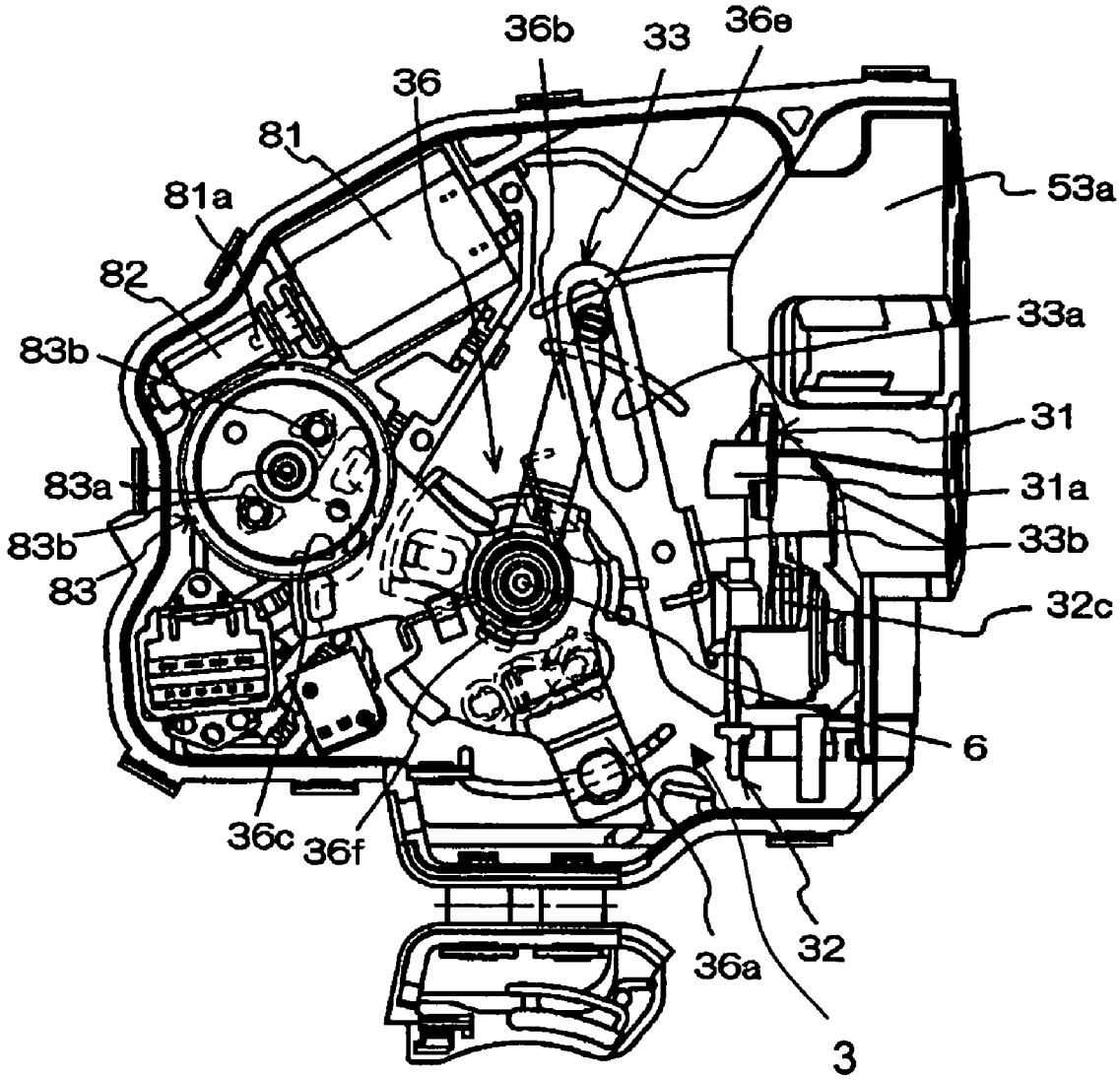
FIG. 9 is a front view illustrating the link mechanism of the vehicle door lock apparatus, according to the present invention, in a locked state.
Figure 9:
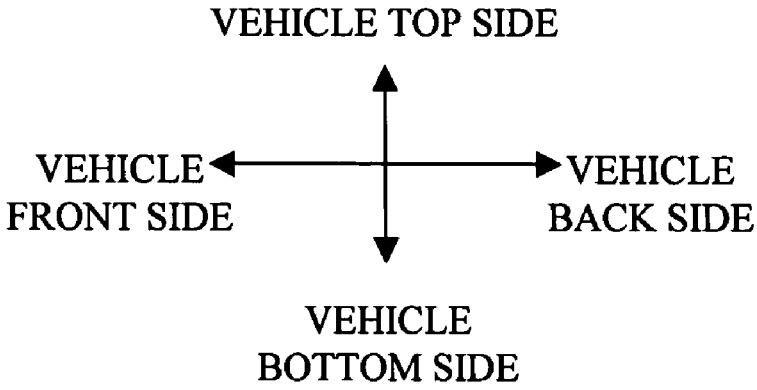

As shown in FIG. 4, FIG. 5 and FIG. 6, the open link 33, the inside opening lever 34 and the inside lever 35 are received in the first cavity A. The open link 33 is arranged in perpendicular to crosses the outside opening lever 32. The open link 33 is movably supported on one end of the outside opening lever 32 and moves between the unlocked position shown in FIG. 5*a* and the locked position shown in FIG. 9. When the open link 33 is in the unlocked position (see FIG. 5), the rear door is put in the unlocked state, in which, when the outside door handle (not shown) or the inside door handle (not shown) is manipulated in a closed state of the rear door, the latch mechanism 2 is operated to place the rear door in an openable state relative to the vehicle body. Further, when the open link 33 is in the locked position (see FIG. 9), the rear door is put in the locked state, in which, even if the outside door handle or the inside door handle is manipulated while the rear door is in a closed state, the latch mechanism 2 is not operated, so that the rear door cannot be placed in the openable state relative to the vehicle body.

As shown in FIG. 5, a elongated hole 33*a* is formed in the end of the open link 33 lengthwise, and an L-shaped flange wall 33*b* is formed on the middle portion of the open link 33 to come into contact with the flange wall 31*a* of the lift lever 31.

As shown in FIG. 6, the inside opening lever 34 is rotatablely supported on the support shaft 6. One end of the inside opening lever 34 is provided with an arm part 34*a*, which comes into contact with the flange wall 33*b* of the open link 33. A slide bush 37 is movably supported on the other end of the inside opening lever 34, thus being movable in a longitudinal direction. The slide bush 37, supported on the inside opening lever 34, is provided with a pin part 37*a*.

The inside lever 35 is rotatablely supported on the support shaft 6, as shown in FIG. 6. One end of the inside lever 35 is provided with an L-shaped modified elongated hole 35*c*, which includes a straight elongated hole 35*a* and an arcuate elongated hole 35*b* arranged around the support shaft 6, and the straight elongated 35*a* and the arcuate elongated hole 35*b* together form a continuous L-shape. The modified elongated hole 35*c* receives the pin part 37*a* of the slide bush 37, which is supported on the inside opening lever 34. Thus, the inside opening lever 34 is coupled to the inside lever 35 through the slide bush 37. Further, one end of the inside lever 35 is connected to the inside door handle of the rear door using a cable (not shown). Because the inside opening lever 34 is coupled to the inside lever 35 through the slide bush 37, the inside opening lever 34 can be maintained at the initial position shown in FIG. 6.

As shown in FIG. 7, the locking lever 36 is received in the first cavity A and comprises the active lever 36*a* and the sub-lever 36*b*. In the main casing 51, the active lever 36*a* is rotatablely supported around the support shaft 6 by the boss part 7, which will be described in detail later herein. Further, the sub-lever 36*b* is rotatablely fitted over the active lever 36*a*, so that the sub-lever 36*b* is rotatable around the support shaft 6. The active lever 36*a* and the sub-lever 36*b* are coupled to each other such that the two levers 36*a* and 36*b* can be integrally rotated in a locking direction (counterclockwise in FIG. 5 and FIG. 9), and can be rotated in conjunction with each other in an unlocking direction (clockwise in FIG. 5 and FIG. 9) by a spring 36*f*, which is provided around the support shaft 6.

Figure 8:
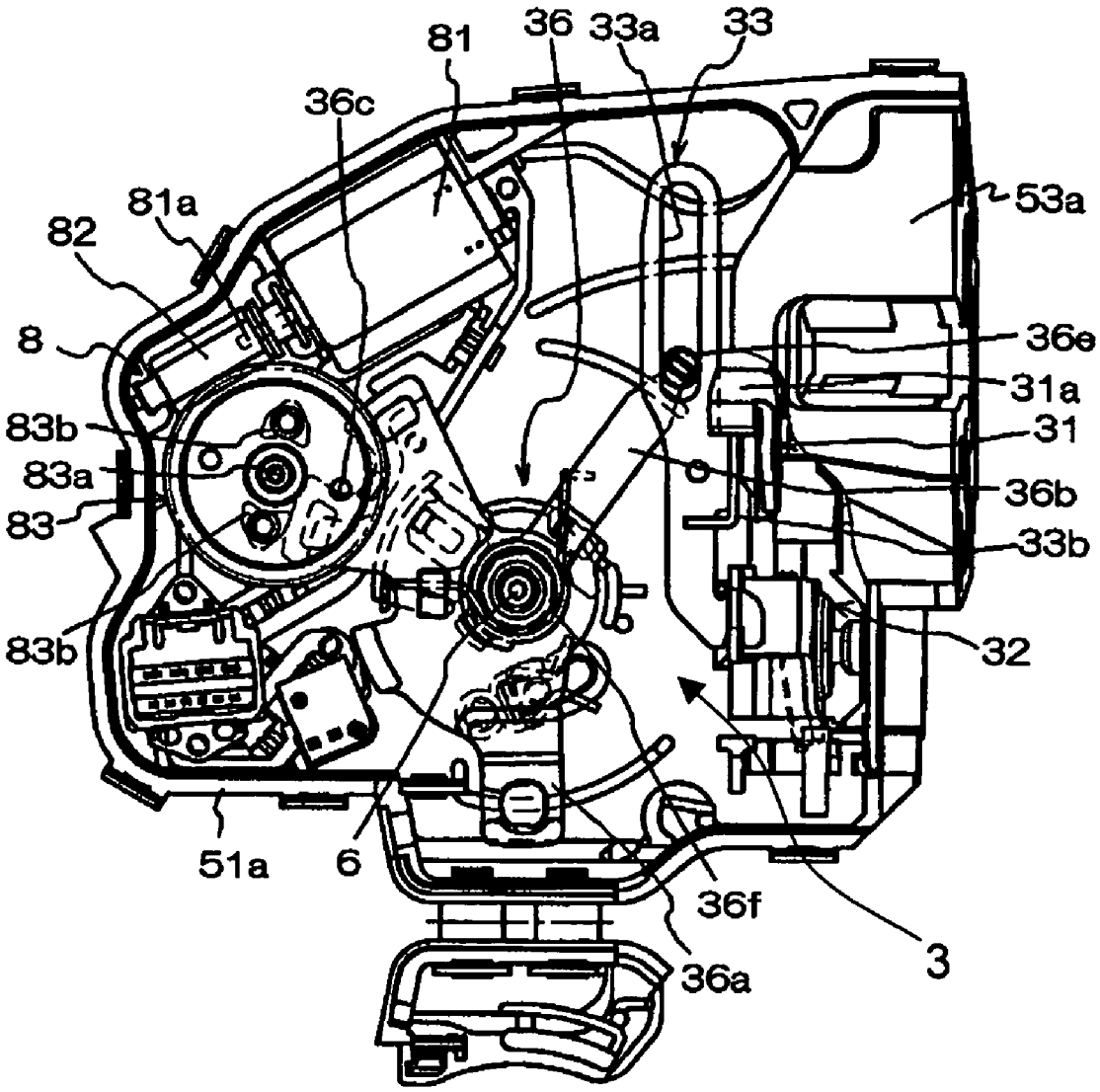
FIG. 8 is a front view illustrating the operation of the link mechanism of the vehicle door lock apparatus, according to the present invention, in an unlocked state.
Figure 8:
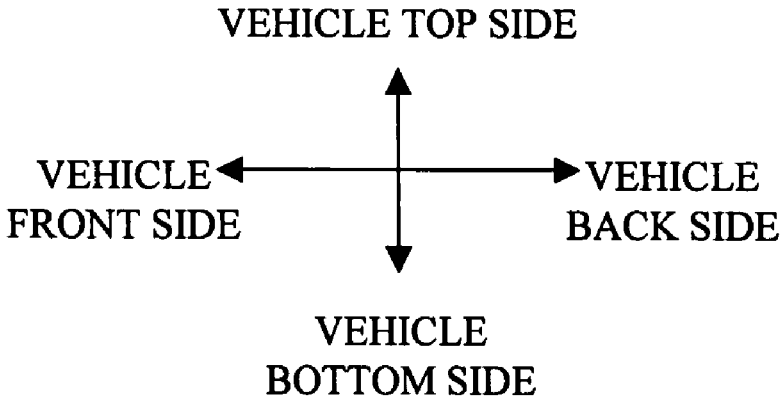

As shown in FIG. 8, the locking slot 36*c* is formed in the first end of the active lever 36*a* of the locking lever 36. Further, the second end of the active lever 36*a* is connected to the inside locking knob (not shown) of the rear door using a cable. The sub-lever 36*b* of the locking lever 36 is arranged to protrude from the active lever 36*a*. Further, the end of the sub-lever 36*b* is provided with a bush 36*e*, which is inserted into the elongated hole 33*a* of the open link 33, so that the sub-lever 36*b* is coupled to the open link 33. When the locking lever 36 is rotated in the locking direction, the open link 33 is changed from the unlocked position to the locked position. Meanwhile, when the locking lever 36 is rotated in the unlocking direction, the open link 33 is changed from the locked position to the unlocked position.

As shown, in FIG. 5, an actuator 8, which is provided with an electric motor 81 as a drive source, is installed in the first cavity A. A worm gear 82 is secured to the rotating shaft 81*a* of the electric motor 81, thus being rotated along with the rotating shaft 81*a*. A wheel gear 83 is rotatablely supported in the main casing 51 of the housing 5 by a pin 83*a*, and engages with the worm gear 82. The wheel gear 83 is provided with a pair of locking protrusions 83*b*. The locking protrusions 83*b* are arranged to advance into or retract from the locking slot 36*c* of the active lever 36*a* in response to rotation of the wheel gear 83, thus being coupled to or decoupled from the active lever 36*a*.

When the electric motor 81 is rotated in one direction, the wheel gear 83, engaging with the worm gear 82, is rotated clockwise as seen in FIG. 5. The rotation of the wheel gear 83 causes one locking protrusion 83*b* to be inserted into the locking slot 36*c* of the active lever 36*a*, so that the wheel gear 83 is coupled to the active lever 36*a*. Thus, the active lever 36*a* is rotated counterclockwise along with the sub-lever 36*b* as seen in FIG. 5, so that the locking lever 36 is rotated in the locking direction. Further, when the electric motor 81 is rotated in the opposite direction, the wheel gear 83, engaging with the worm gear 82, is rotated counterclockwise in FIG. 9. The rotation of the wheel gear 83 causes the other locking protrusion 83*b* to be inserted into the locking slot 36*c* of the active lever 36*a*, so that the wheel gear 83 is coupled to the active lever 36*a*. Thus, the active lever 36*a* is rotated clockwise along with the sub-lever 36*b* in FIG. 9 by the spring 36*f*, so that the locking lever 36 is rotated in the unlocking direction.

The basic operation of the door lock apparatus will be described hereinbelow.

FIG. 5 shows a state of the link mechanism 3 of the door lock apparatus, in which the rear door is put in a closed state by the latch mechanism 2 of the door lock apparatus (the latch mechanism 2 is in a latched state) and, at the same time, the link mechanism 3 is in an unlocked state. Further, in the above state, the outside opening lever 32 is placed at the initial position shown in FIG. 4, while the inside opening lever 34 is placed at the initial position shown in FIG. 6.

When the outside door handle of the rear door is manipulated while in the above state, the opening lever 32 is rotated counterclockwise from its initial position, as seen in FIG. 4, while the open link 33 is moved upwards in FIG. 4 and FIG. 5, thus realizing the state shown in FIG. 8. Therefore, the flange wall 33*b* of the open link 33 comes into contact with the flange wall 31*a* of the lift lever 31, thus rotating the lift lever 31. Because the lift lever 31 is secured to the pawl shaft 23 (see FIG. 1 and FIG. 3), the pawl 24 is rotated along with the lift lever 31. Therefore, the latch mechanism 2 is changed from the latched state to the unlatched state, so that the rear door is openable relative to the vehicle body.

When the inside handle of the rear door is manipulated, the inside lever 35 is rotated clockwise as viewed in FIG. 6. The rotation of the inside lever 35 is transmitted to the inside opening lever 34 through the slide bush 37. Therefore, the inside opening lever 34 is rotated clockwise in FIG. 6 from its initial position. When the inside opening lever 34 is rotated clockwise in FIG. 6, the arm part 34*a* of the inside opening lever 34 comes into contact with the flange wall 33*b* of the open link 33, so that the open link 33 is moved upwards as viewed in FIG. 4 and FIG. 5, and realizes the state shown in FIG. 8. Thus, the flange wall 33*b* of the open link 33 comes into contact with the flange wall 31*a* of the lift lever 31, so that the lift lever 31 is rotated. Therefore, the latch mechanism 2 is changed from the latched state to the unlatched state, so that the rear door is openable relative to the vehicle body.

Figure 10:
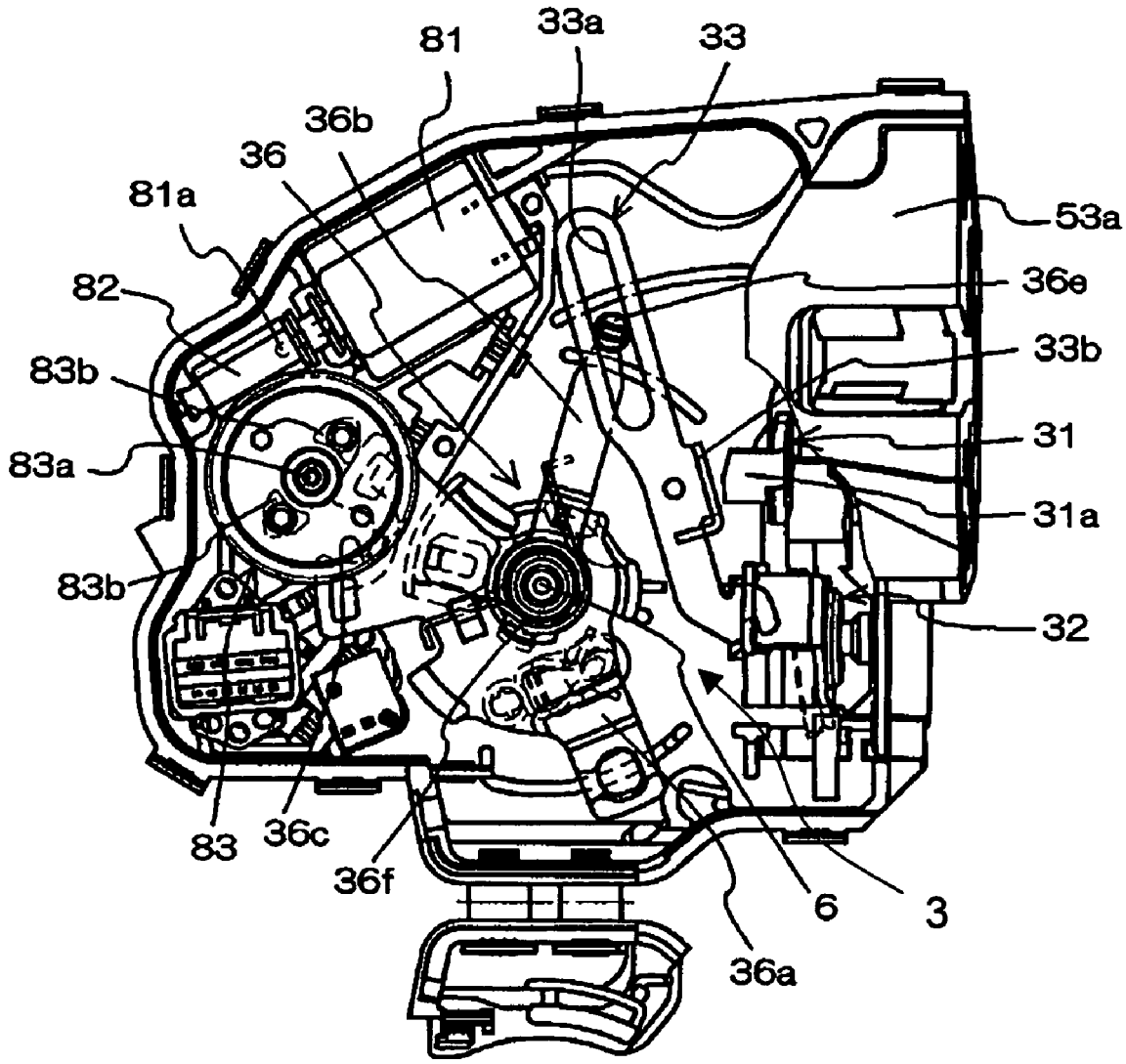
FIG. 10 is a front view illustrating the operation of the link mechanism of the vehicle door lock apparatus according to the present invention in a locked state.
Figure 10:
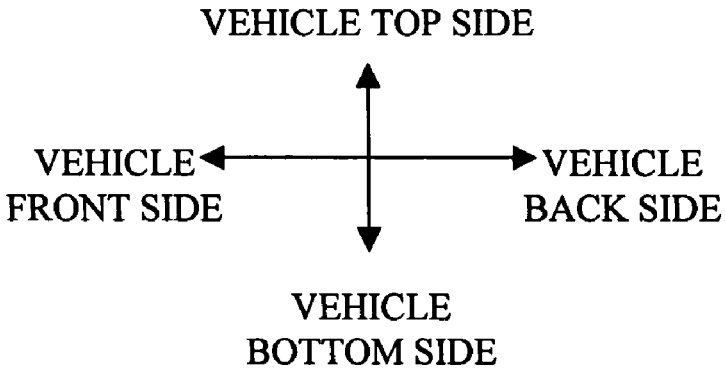

When the locking lever 36 is rotated in the locking direction by operating the electric motor 81 or by manipulating the inside lock knob, the rotation of the locking lever 36 is transmitted to the open link 33 through the bush 36*e*, so that the open link 33 is rotated counterclockwise in FIG. 5. Thus, the open link 33 can be changed from the unlocked position to the locked position shown in FIG. 9. In the above state, the flange wall 31*a* of the lift lever 31 is not present on the trace of the flange wall 33*b* of the open link 33 caused by the rotation of the open link 33. Thus, even if the inside handle or the outside handle of the rear door in the above state is manipulated, the flange wall 33*b* does not come into contact with the flange wall 31*a* (see FIG. 10). Thus, manipulation of the handle of the rear door in the above state cannot change the latch mechanism 2 from the latched state to the unlatched state or put the rear door in an openable state. Meanwhile, to return the latch mechanism from the state shown in FIG. 9 to the state shown in FIG. 5, the electric motor 81 is rotated in the opposite direction, or the inside lock knob is manipulated in reverse to rotate the locking lever 36 in the unlocking direction.

To put the rear door in the openable state by manipulating the inside door handle, the rotation of the inside lever 35 must be transmitted to the inside opening lever 34 through the slide bush 37. The transmission of rotation of the inside lever 35 to the inside opening lever 34 is realized by placing the pin part 37*a* of the slide bush 37 in the straight elongated hole 35*a*, which communicates with the modified elongated hole 35*c*. However, when the pin part 37*a* is placed in the arcuate elongated hole 35*b* of the modified elongated hole 35*c*, the inside lever 35 is rotated relative to the inside opening lever 34, so that rotation of the inside lever 35 cannot be transmitted to the inside opening lever 34. Thus, even if the inside door handle is manipulated, the rear door does not enter the openable state, thus realizing the so-called "child lock function." Movement of the pin part 37*a* of the slide bush 37 between the straight elongated hole 35*a* and the arcuate elongated hole 35*b* is realized by a sliding motion of the slide bush 37 relative to the inside opening lever 34. The sliding motion of the slide bush 7 is realized by manipulation of a child lock lever 38 shown in FIG. 6.

As shown in FIG. 7, the first casing part 51*a* of the main casing 51 is provided with the boss part 7, which protrudes into the first cavity A. The boss part 7 is shaped as an annular body, with the inner surface 72 and the outer surface 71. Further, the boss part 7 constitutes the annular support of the present invention.

The support shaft 6 is shaped as a cylindrical body, with the flange part 61 formed around the middle portion of the cylindrical support shaft 6. The support shaft 6 has the fixing part 62, which is inserted into the shaft hole of the boss part 7 (annular support) and contacts with the inner surface 72 of the boss part 7. Described in detail, the fixing part 62 is formed on the fixing end (the end on the right-hand side of FIG. 7) of the support shaft 6, based on the flange part 61, and has a diameter almost equal to or slightly greater than the inner surface 72 of the boss part 7. Further, the support shaft 6 has the flange part 61, which has a diameter greater than the outer surface 71 of the boss part 7 and is engaged with the end of the boss part 7. Further, the support shaft 6 comprises the flange part 61, the fixing part 62, extending from the flange part 61 in one direction, the first support part 63, extending from the flange part 61 in the other direction, the second support part 64, extending from the first support part 63 and having a diameter smaller than the first support part 63, and the insert part 65, extending from the second support part 64 and having a diameter smaller than the second support part 64. Described in detail, the front end (the end on the left-hand side of FIG. 7) of the support shaft 6, based on the flange part 61, forms the first support part 63 having the diameter greater than the fixing part 62, the second support part 64 having the diameter smaller than the first support part 63, and the insert part 65, having the diameter smaller than the second support part 64. The support shaft 6 is inserted into the boss part 7 such that the outer surface of the fixing part 62 contacts with the inner surface 72 of the boss part 7, thus being securely installed in the main casing 51. The insert part 65 is inserted into the through hole 52*a* of the first cover 52 and is held by the washer 9 at a desired location relative to the first cover 52. Thus, the support shaft 6 is supported at opposite ends thereof by the main casing 51 and the first cover 52, so that the support shaft 6 is stably held in the housing 5.

The active lever 36*a* of the locking lever 36 is provided with a bushing part 36*g*. The bushing part 36*g* is provided with a bore 36*h*, which has a diameter almost equal to or slightly greater than the outer surface 71 of the boss part 7. Further, the sub-lever 36*b* of the locking lever 36 is provided with a through hole 36*k*. The sub-lever 36*b* is rotatablely supported around the active lever 36*a* by fitting the through hole 36*k* of the sub-lever 36*b* over the bushing part 36*g* of the active lever 36*a*. The active lever 36*a*, which rotatablely supports the sub-lever 36*b*, is rotatablely supported around the boss part 7 by fitting the bore 36*h* of the active lever 36*a* over the boss part 7 such that the inner surface of the bore 36*h* contacts with the outer surface 71 of the boss part 7. In the above state, the sub-lever 36*b* is arranged between the active lever 36*a* and the first casing part 51*a* of the main casing 51. Thus, axial misalignment of the sub-lever 36*b* relative to the active lever 36*a* can be limited. Further, the spring 36*f* is fitted over the bushing part 36*g* at a position opposite the sub-lever 36*b*. The active lever 36*a* is supported on the boss part 7 and, furthermore, the support shaft 6 is inserted into the boss part 7, so that the support strength of the active lever 36*a*, and furthermore, the support strength of the locking lever 36, including the sub-lever 36*b*, can be increased.

The inside opening lever 34 is provided with the flange wall 34*b*, which defines the bore 34*c*. The inside opening lever 34 is rotatablely supported on the support shaft 6 by fitting the bore 34*c* of the flange wall 34*b* over the first support part 63 of the support shaft 6 such that the inner surface of the flange wall 34*b* contacts with the outer surface of the first support part 63. Further, the inside lever 35 is provided with the through hole 35*e*. The inside lever 35 is rotatablely supported on the support shaft 6 by fitting the through hole 35*e* of the inside lever 35 over the second support part 64 of the support shaft 6, such that the inner surface of the through hole 35*e* contacts with the outer surface of the second support part 64 of the support shaft 6. In the above state, the inside lever 35 is interposed between the inside opening lever 34 and the first cover 52, such that the inside lever 35 can be in contact with the end of the flange wall 34*b*. Further, the inside opening lever 34 is interposed between the flange part 71 and the inside lever 35, and comes into contact with the flange part 71, thus limiting axial misalignment of the inside lever 35 relative to the inside opening lever 34. As described above, the inside opening lever 34 and the inside lever 35 are supported on the support shaft 6, which is held at opposite ends thereof in the housing 5, so that the support strength of the levers 34 and 35 can be increased.

As described above, the inside opening lever 34 and the inside lever 35 are supported on the support shaft 6, while the locking lever 36 is supported on the boss part 7, which is combined with the support shaft 6. Thus, the levers 34, 35 and 36 may be coaxially arranged, so that a small door lock apparatus, which can be easily installed in the rear door, can be realized.

Further, in the embodiment of the present invention, the door lock apparatus is installed in the rear door. However, it should be understood that the apparatus may be installed in a front door. In such a case, the door lock apparatus of the present invention does not have the child lock function, in other words, the door lock apparatus does not have the inside lever 35 or the slide bush 37, rather, the inside opening lever 34 is coupled to the inside door handle through the cable 35*d*. In the above state, the support shaft 6 supports only the inside opening lever 34.

While the invention has been shown and described with respect to the preferred embodiments, it will be understood by those skilled in the art that various changes and modification may be made without departing from the spirit and scope of the invention as defined in the following claims.

The invention claimed is:

1. A door lock apparatus for vehicles, comprising:

a latch mechanism for maintaining a vehicle door in a closed state relative to a vehicle body;

a latch actuating link coupled to the latch mechanism and actuating the latch mechanism to place the vehicle door in an openable state relative to the vehicle body, said latch actuating link including two latch actuating levers and a lift lever;

a lock actuating link for connecting or disconnecting the latch actuating link to or from the latch mechanism, and thus making the latch mechanism operable or inoperable when the latch actuating link is actuated, said lock actuating link including a lock actuating lever and an open link; and a base unit for supporting the latch actuating link and the lock actuating link, wherein:

the base unit provides an arcuate annular support comprising an inner surface and an outer surface and a support shaft held in the annular support, the support shaft comprises a flange part which has a diameter greater than the outer surface of the annular support and is in contact with one end of the annular support, the support shaft comprises a fixing part which is press fitted into the annular support such that the fixing part contacts with the inner surface of the annular support, and which extends from a first side of the flange part; a first support part that extends from a second side of the flange part; a second support part that extends from the first support part and has a diameter smaller than the first support part; and an insert part that extends from the second support part and has a diameter smaller than the second support part, said latch actuating levers being rotatablely supported on an outer circumferential surface of the support shaft, and said lock actuating lever being rotatablely supported on an outer circumferential surface of the annular support.

2. The door lock apparatus for vehicles according to claim 1, wherein the base unit comprises:

a casing having the annular support; and a cover secured to the casing, supporting one end of the support shaft, and housing both the latch actuating lever and the lock actuating lever therein in cooperation with the casing.

3. The door lock apparatus for vehicles according to claim 1, wherein the annular support is shaped as an annular body having the inner surface and the outer surface.

4. The door lock apparatus for vehicles according to claim 1, wherein the latch actuating levers of the latch actuating link comprise:

a first lever rotated by a door handle; and an opening lever rotated through a slide bush in response to the rotation of the first lever; and wherein the lift lever rotates through the open link in response to the rotation of the opening lever, thus opening or closing the latch mechanism, and the lock actuating lever comprises:

a locking lever rotated by a motor or a lock knob; and the open link rotates between a locked state and an unlocked state through a bush in response to the rotation of the locking lever.

5. The door lock apparatus for vehicles according to claim 4, wherein the latch actuating lever, which is rotatablely supported on the support shaft, is the opening lever, and the lock actuating lever, which is rotatablely supported on the annular support, is the locking lever.

6. The door lock apparatus for vehicles according to claim 4, wherein the first lever is an inside lever, and is rotatablely supported on the support shaft, the slide bush is slidably supported on the opening lever, and is connected to or disconnected from the inside lever, and the opening lever comprising;

a flange wall on a periphery thereof such that a front end of the flange wall comes into contact with the inside lever in an axial direction and an inner surface of the flange wall contacts with an outer surface of the support shaft; and a bore formed to receive the support shaft.

7. The door lock apparatus for vehicles according to claim 5, wherein the locking lever comprises:

an active lever rotatablely supported around the annular support; and a sub-lever supported on the active lever to be rotated relative to the active lever at a location around the support shaft.

8. The door lock device according to claim 1, wherein an axial length of the annular support is equal to or more than an axial length of the fixing part of the support shaft.

9. The door lock device according to claim 1, wherein the annular support covers one end of the fixing part of the support shaft.

10. The door lock device according to claim 1, further comprising an outside opening lever, wherein the lift lever rotates through the open link in response to the rotation of the outside opening lever, thus opening or closing the latch mechanism.

* * * * *